US006710779B2

(12) United States Patent
Chung

(10) Patent No.: US 6,710,779 B2
(45) Date of Patent: Mar. 23, 2004

(54) IMAGE CONVERSION APPARATUS FOR CONVERTING A SCREEN SIGNAL

(75) Inventor: Tzu-Chiang Chung, Taipei (TW)

(73) Assignee: BenQ Corporation, Tao-Yuan Hsien (TW)

( * ) Notice: Subject to any disclaimer, the term of this patent is extended or adjusted under 35 U.S.C. 154(b) by 189 days.

(21) Appl. No.: 09/982,391

(22) Filed: Oct. 18, 2001

(65) Prior Publication Data

US 2002/0047854 A1 Apr. 25, 2002

(30) Foreign Application Priority Data

Oct. 20, 2000 (TW) ..... 89122055 A

(51) Int. Cl.[7] ..... G09G 5/02; G09G 5/10
(52) U.S. Cl. ..... 345/600; 345/690
(58) Field of Search ..... 345/600, 690

(56) References Cited

U.S. PATENT DOCUMENTS 4,375,650 A * 3/1983 Tiemann ..... 375/240.2
5,774,702 A * 6/1998 Mitsuishi et al. ..... 713/629
6,028,588 A * 2/2000 Yoon ..... 345/589
6,239,729 B1 * 5/2001 Takeuchi ..... 341/100
6,340,959 B1 * 1/2002 Inamori ..... 345/3.1
6,356,253 B2 * 3/2002 Uchino et al. ..... 345/89
6,542,162 B1 * 4/2003 Hrusecky et al. ..... 345/501

* cited by examiner

*Primary Examiner*—Matthew C. Bella
*Assistant Examiner*—Anthony Blackman
(74) *Attorney, Agent, or Firm*—Winston Hsu

(57) ABSTRACT

This invention provides an image conversion apparatus for converting a screen signal to display a converted screen signal on a monitor, with the screen signal comprising a plurality of first image signals. The image conversion apparatus comprises a format memory in which at least one data group is stored and a conversion matrix for conversion of the first image signals to a plurality of corresponding second image signals, a latch circuit electrically connected to the conversion matrix for latching the second image signals transmitted from the conversion matrix, and a control circuit electrically connected to the format memory and the latch circuit for controlling the latch circuit so that the latch circuit latches chosen second image signals, according to a lock signal in the data group transferred from the format memory.

6 Claims, 4 Drawing Sheets

IMAGE CONVERSION APPARATUS FOR CONVERTING A SCREEN SIGNAL

BACKGROUND OF THE INVENTION

1. Field of the Invention

The present invention relates to a digital image conversion apparatus, and more specifically to a programmable digital image conversion apparatus.

2. Description of the Prior Art

Due to digital image systems such as digital still cameras (DSC) or digital video cameras having light volume and being capable for use in a computer system or on the internet directly, digital image systems have become the main stream products of the image system market.

In general, a digital image system has a monitor to display digital signals recorded by the digital image system. Users may use the monitor as a viewfinder to help determine a proper position to take pictures, or review the pictures taken so as to edit or delete unsatisfactory pictures.

Please refer to FIG. 1. FIG. 1 is a functional block diagram of a prior art digital image system 100. The digital image system 100 comprises a digital image forming apparatus 120 for generating a screen signal 140. The screen signal 140 will be converted by an image conversion apparatus 160 and then a converted screen signal will be displayed on a monitor 180. The digital image forming apparatus 120 always uses a charge-coupled device (CCD) as an image sensor. The monitor 180 always uses a liquid crystal display (LCD) as a display. However, data formats of the screen signal 140 generated by the digital image forming apparatus 120 are usually in a data format that is incompatible with the monitor 180. At present, there is not any standard specification of the monitor 180. Due to the lack of a standard, the digital image system 100 needs the installation of the image conversion apparatus 160 between the digital image forming apparatus 120 and the monitor 180 as a data format conversion interface. In this way, the monitor 180 is capable of properly displaying the digital signals recorded by the digital image forming apparatus 120.

The prior art image conversion apparatus 160 is a circuit that is designed for handling the screen signal 140, and generates data formats that the particular monitor 180 can accept. Therefore, the image conversion apparatus 160 can be only used for the particular monitor 180. If a manufacturer of the digital image system 100 wishes to use other types of monitors 180, the manufacturer of the digital image system 100 must implement a new circuit in the image conversion apparatus 160 so the image conversion apparatus 160 can provide appropriate data formats to the new monitor 180. For the manufacturer of the digital image system 100, it is inconvenient to design different circuits in the image conversion apparatus 160 to match the different monitors. This is a drawback of the prior art image conversion apparatus 160.

SUMMARY OF THE INVENTION

It is therefore a primary objective of the claimed invention to provide a programmable digital image conversion apparatus for overcoming the drawbacks of the prior art digital image conversion apparatus.

The claimed invention, briefly summarized, discloses a digital image conversion apparatus. The digital image conversion apparatus is provided for converting a screen signal to display a converted screen signal on a monitor. The screen signal comprises a plurality of first image signals. The image conversion apparatus comprises a format memory, a conversion matrix, a latch circuit, and a control circuit. There is at least one data group stored in the format memory. The conversion matrix is used to convert the first image signals to a plurality of corresponding second image signals. The latch circuit is electrically connected to the conversion matrix for latching the second image signals transmitted from the conversion matrix. The control circuit is electrically connected to the format memory and the latch circuit for controlling the latch circuit, so that the latch circuit latches chosen second image signals according to a lock signal in the data group transferred from the format memory.

It is an advantage of the claimed invention that the image conversion apparatus of the digital image system employs the stored data of the data group in the format memory to control image conversion. For different monitors, a manufacturer needs only to change data within storage checks of the data group so as to be capable of performing image conversion.

These and other objectives and advantages of the present invention will no doubt become obvious to those of ordinary skill in the art after reading the following detailed description of the preferred embodiment that is illustrated in the various figures and drawings.

DETAILED DESCRIPTION OF THE PREFERRED EMBODIMENT

Figure 1:
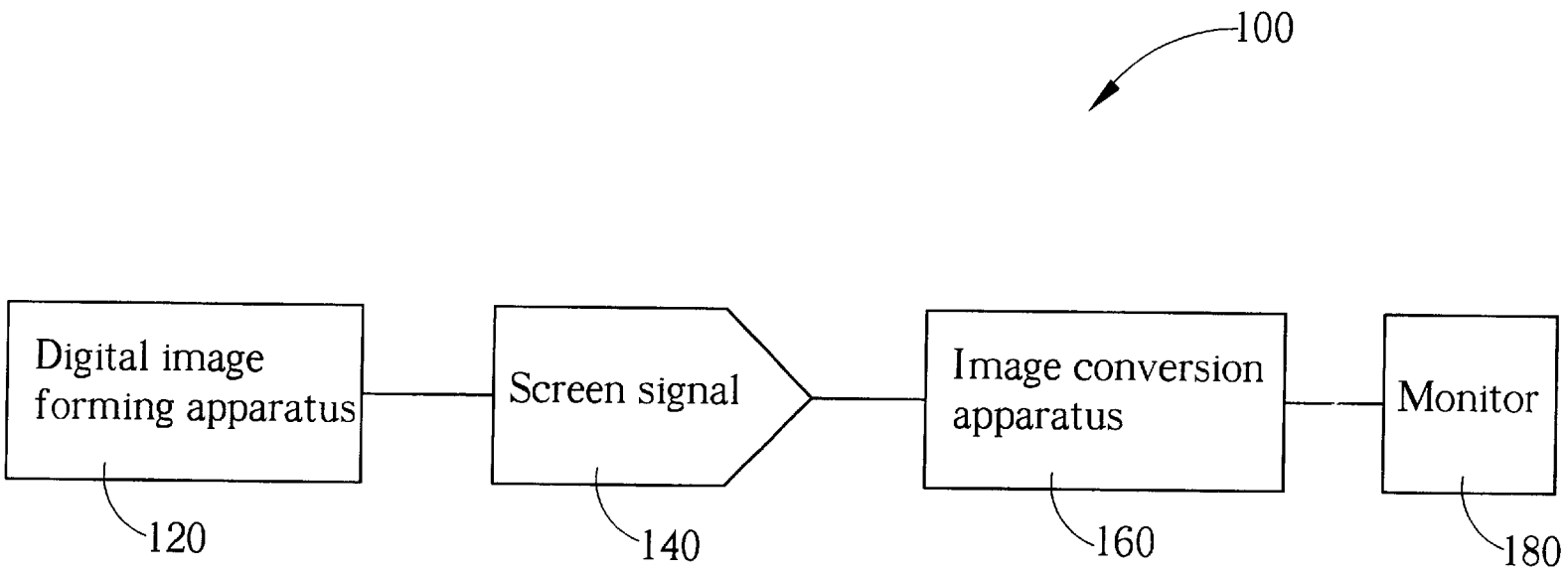
Fig. 1 Prior art
FIG. 1 is a functional block diagram of a prior art digital image system.
Figure 2:
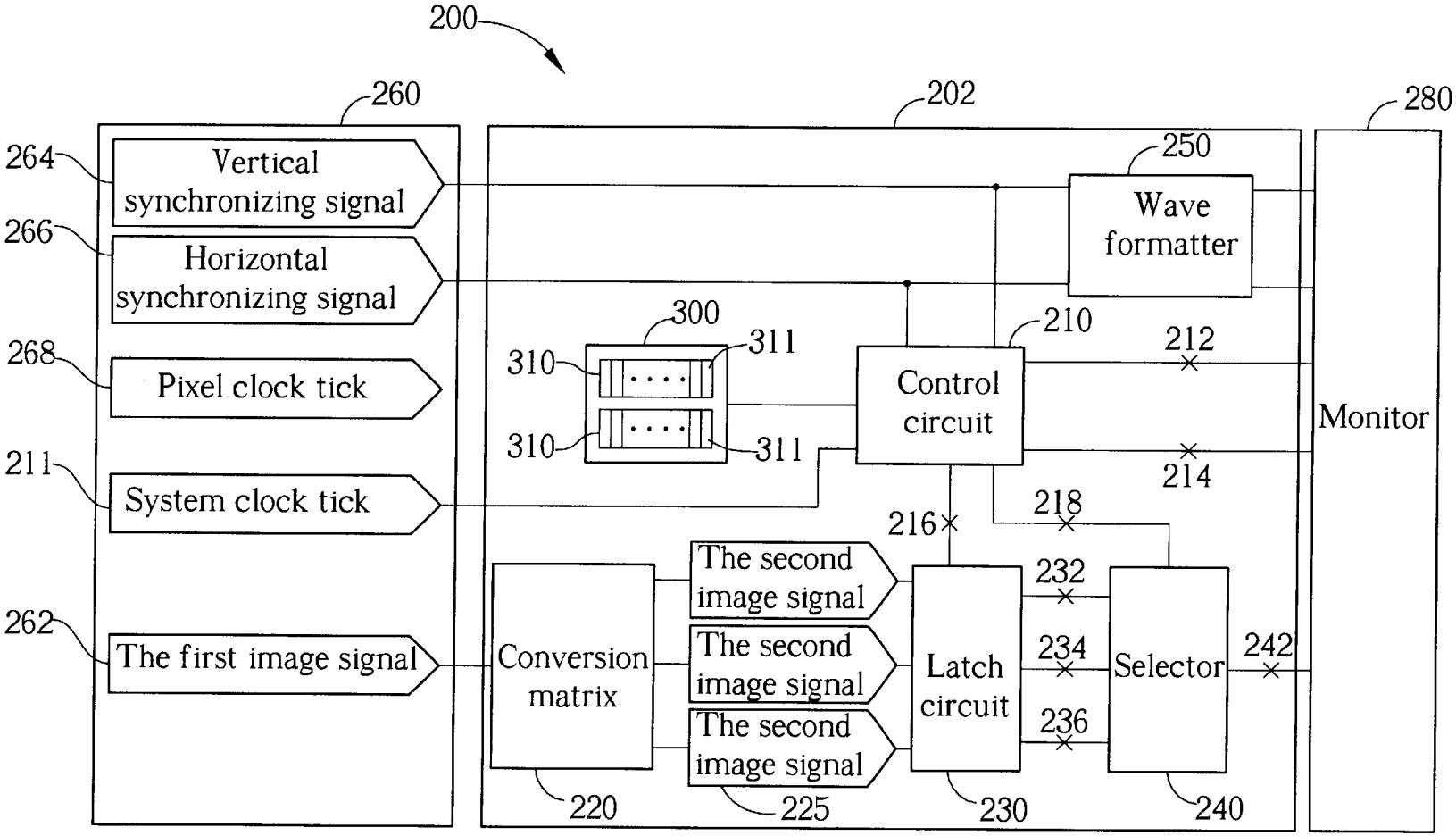
FIG. 2 is a functional block diagram of a present invention digital image system.

Please refer to FIG. 2. FIG. 2 is a functional block diagram of a present invention digital image system 200. The digital image system 200 comprises an image conversion apparatus 202 for converting a screen signal 260 for proper display on a monitor 280. The screen signal 260 comprises a first image signal 262, a vertical synchronizing signal 264, a horizontal synchronizing signal 266, and a pixel clock tick 268. The first image signal 262 is generally a YUV signal, where the Y being a brightness component, U being a color difference signal corresponding to B-Y, and V being a color difference signal corresponding to R-Y. The image conversion apparatus 202 comprises a control circuit 210, a format memory 300, a wave formatter 250, a conversion matrix 220, a latch circuit 230 and a selector 240. The latch circuit 230 may be implemented by D flip-flops.

The format memory 300 has a data group 310 of odd scanning lines and a data group 310 of even scanning lines. Each data group 310 comprises a plurality of storage checks 311. The conversion matrix 220 is used to convert the first image signals 262 to corresponding second image signals 225 which is a format that can be accepted by the monitor 280. The second image signals 225 always are RGB (red, green and blue) signals. The three second image signals 225 shown in FIG. 2 respectively represent red signals, green signals and blue signals. The second image signals 225 are used to form a pixel on the monitor 280. The wave formatter 250 is able to convert the horizontal synchronizing signals 266 and the vertical synchronizing signals 264 of the screen signal 260 to horizontal synchronizing signals and vertical synchronizing signals that accepted by the monitor 280. Comparing the horizontal and vertical synchronizing signals contained in the screen signal 260, the horizontal and vertical synchronizing signals that may be accepted by the monitors 280 generally have different polarization, pulse width, or time delay. Therefore a wave formatter 250 is used to convert these or other parameters of the vertical synchronizing signals 264 and the horizontal synchronizing signals 266 to match the specifications of the monitor 280. The system clock tick 211 detonates the control circuit 210 so as to make the control circuit 210 control the operation of the image conversion apparatus 202, and use the data contained in each storage check 311 of the format memory 300 to generate a first pixel clock tick 212 and a second pixel clock tick 214 that can be accepted by the monitor 280. The control circuit 210 generates latch signals 216 and color signals 218 according to the data contained in the storage checks 311 of the data group 300, so as to control the latch circuit 230 and the selector 240 and provide proper displaying signals 242 to the monitor 280. The latch circuit 230 comprises D Flip-flops. The timing of the latch circuit 230 is also provided by the system clock tick 211.

The control circuit 210 of the present invention image conversion apparatus 202 utilizes data contained in each storage check 311 of the data group 310 to determine how to convert the screen signal 260 to data formats that the monitor 280 can accept. Therefore if the manufacture of the digital image system 200 desires to change the monitor 280 types, it does not need to redesign a new image conversion apparatus 202, but only to replace the data contained in each storage checks 311 of the data group 310. Manufactures of the digital image systems 200 can save considerable time and cost when changing monitor type in their products.

Figure 3:
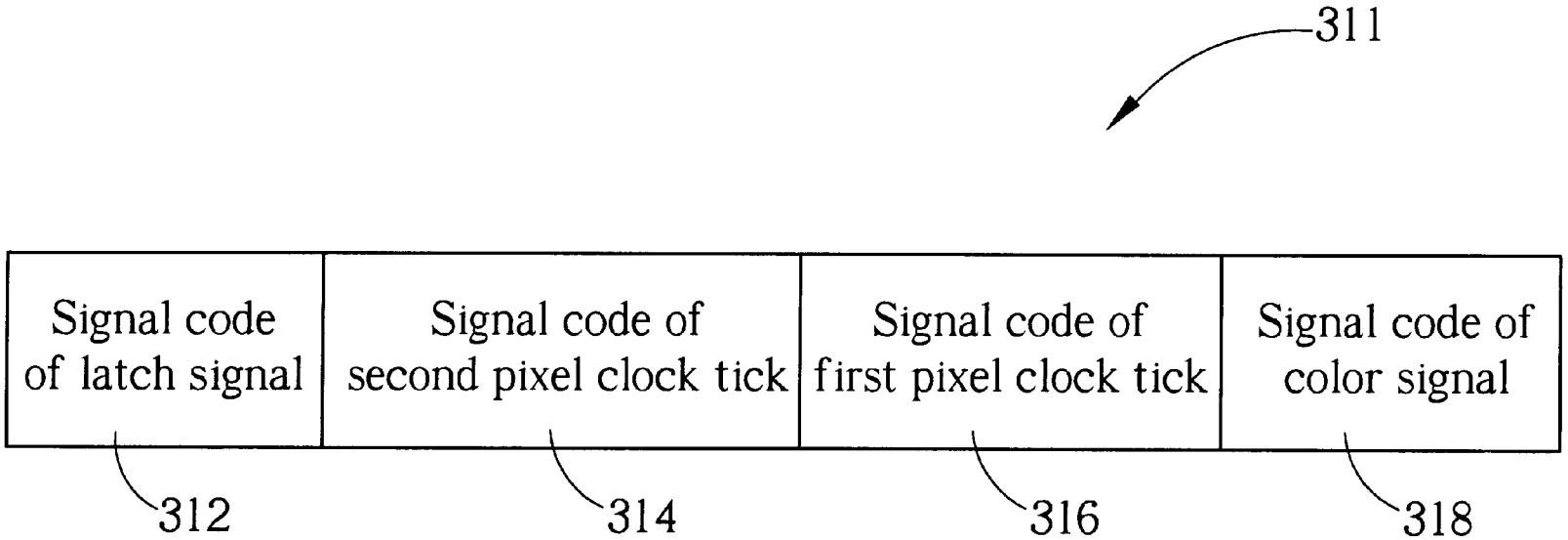
FIG. 3 is a diagram of data formats in data groups.

Please refer to FIG. 3. FIG. 3 is a diagram of data formats in each storage check 311 of the data groups 310. The storage check 311 comprises a signal code 312 of a latch signal 216, a signal code 316 of a first pixel clock tick 212, a signal code 314 of a second pixel clock tick 214, and a signal code 318 of a color signal 218. The control circuit 210 generates the latch signal 216 to control the latch circuit 230 according to the signal code 312. The control circuit 210 generates the color signal 218 to control the selector 240 according to the signal code 318. The control circuit 210 generates the first pixel clock tick 212 according to the signal code 316, and generates the second pixel clock tick 214 according to the signal code 314. Each signal code 312, 314, 316 and 318 has two bits in the embodiment mentioned thereinafter, so that the storage check 311 has eight bits in total. The present invention image conversion apparatus 202 can generate not only the first pixel clock tick 212 and the second pixel clock tick 214, but also modify the number of pixel clock ticks to meet practical needs. It should be noted that the number of the signal codes in the storage checks 311 must match the number of the pixel clock ticks 212, so that changing the number of pixel clock ticks 212 would also change the size of the storage checks 311.

The operation principle of the present invention image conversion apparatus 202 can be described using the embodiment as follows: In the embodiment, there are 720 pixel clock ticks and image pixels between each two horizontal synchronizing signals 266. However, each scanning line on the monitor 280 only has 640 pixel clock ticks and 320 image pixels, and each pixel can only display one color. In order to properly display images on the monitor 280, the control circuit 210 must reduce the 720 pixel clock ticks to 640 pixel clock ticks, and reduce the 720 image pixels to 320 image pixels. Moreover, the proper color to be outputted has to be chosen. Therefore, the image is capable of displaying on the monitor 280.

Figure 4:
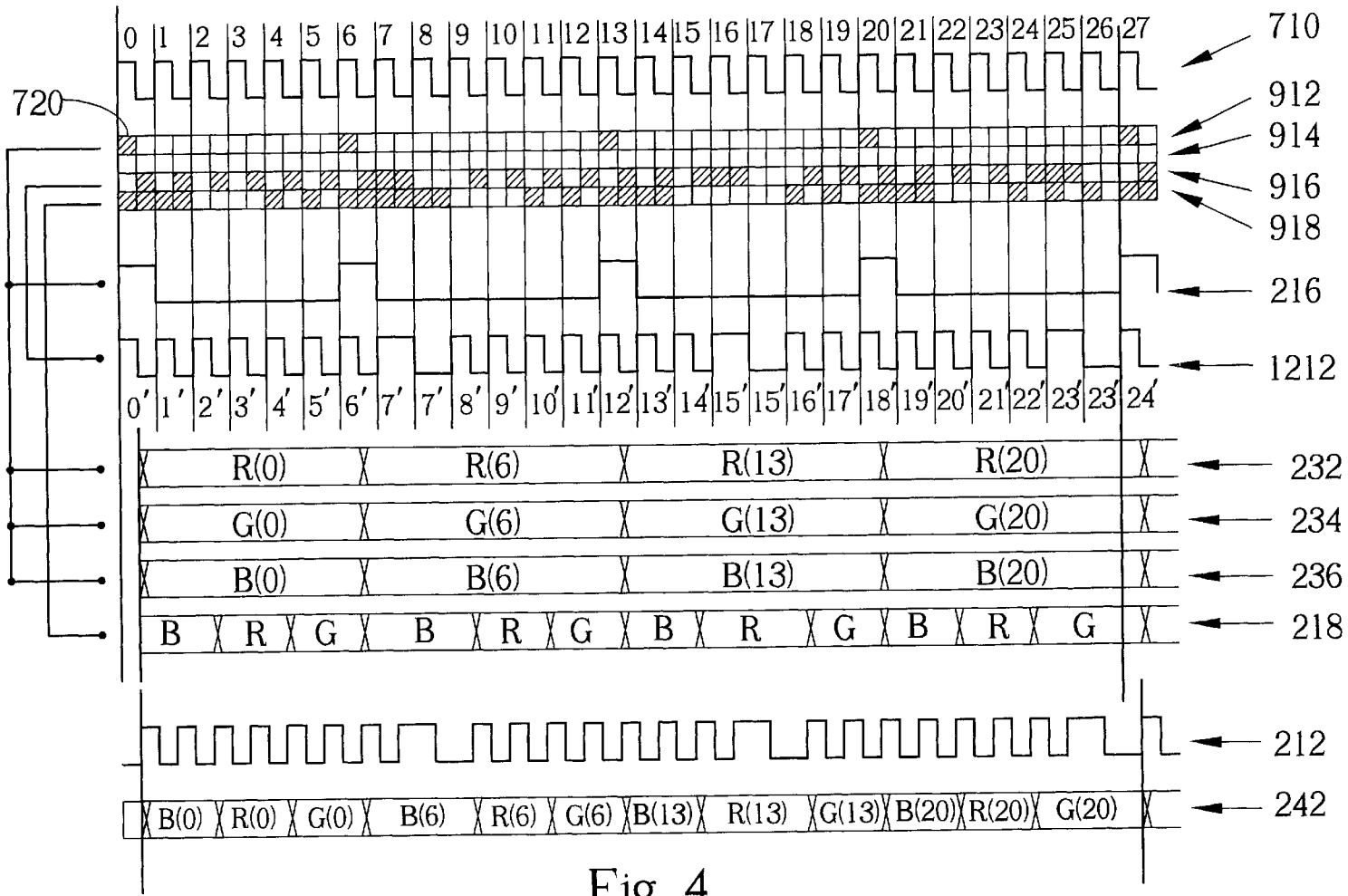
FIG. 4 is a signal pulse diagram of the present invention digital image system when operating.

Please refer to FIG. 4. FIG. 4 is a signal pulse diagram of the present invention image conversion apparatus 202 when operating. Signals 710 are the pixel clock ticks 268 of the screen signals 260, and each square wave of the signal 710 represents a period. The digital image system 200 performs a sampling of the second image signal 225 in each period, so each period is in line with a pixel datum of a pixel. As FIG. 4 shows, each square wave of the signal 710 is numbered (from 0 to 26). Each of the square waves numbered from 0 to 26 is in line with the pixel data of a corresponding pixel. In the operation process of the present invention image conversion apparatus 202, each square wave corresponds to data stored in a corresponding storage check 311. Each square wave is defined as a conversion period in the following description. A datum rank 912 shown in FIG. 4 arrays the signal codes 312, which represents the latch signal 216 in the storage check 311, into alignment in order to match each conversion period. As mentioned before, the signal code 312 has two bits in the storage check 311. Therefore, the datum rank 912 shown in FIG. 4 has two checks 720 in each conversion period, and each check is represented as a bit. A filled check is represented as 1, and a blank check is represented as 0. This same arrangement is used in a datum rank 914 to represent the signal code 314, which is used to generate the second pixel clock tick 214. A similar arrangement in a datum rank 916 represents the signal code 316, which is used to generate the first pixel clock tick 212. The same arrangement in a datum rank 918 represents the signal code 318, which is used to generate the color signals 218. In the present embodiment, the signal code 318 represents blue (B) when the code is 11, represents red (R) when the code is 00, and represents green (G) when the code is 10.

A signal 216 shown in FIG. 4 is the latch signal 216 that the control circuit 210 uses to control the latch circuit 230 (please refer to FIG. 2 as well). Signals 232, 234 and 236 are monochrome signals transmitted from the latch circuit 230 to the selector 240. A signal 218 is the color signal 218 that the control circuit 210 uses to control the selector 240. A signal 212 is the first pixel clock tick 212, which is output from the control circuit 210 to the monitor 280. A signal 242 is the displaying signal 242, which is output from the selector 240 to the monitor 280.

The operation of the present invention image conversion apparatus 202 can be described as follows (please refer to FIG. 2 as well): The operating signal pulse of the image conversion apparatus 202 are controlled by the system clock ticks 211, and the frequency of the system clock ticks 211 is double that of the pixel clock ticks 268. When the system clock ticks 211 are enabled, the control circuit 210 can match the horizontal synchronizing signals 266 and the vertical synchronizing signals 264 of the screen signals 260 to synchronously read the data of one storage check 311 in each conversion period of the signal 710. Please refer to the datum rank 912 shown in FIG. 4, in the conversion period of a title 0, the control circuit 210 reads the signal code from the storage checks 311 is 10. The control circuit 210 generates a high-level latch signal 216 according to the signal code 312, and the high-level latch signal 216 will enable the latch circuit 230 to latch the second image signal 225 in accordance with the conversion period of the title 0. The second image signals 225 are the signals which are labeled R(0), G(0) and B(0) in the monochrome signals 232, 234 and 236, respectively. The symbol 0 inside the bracket of the labels R(0), G(0) and B(0) corresponds to the conversion period of the title 0. Because the latch circuit 230 is implemented by D flip-flops, when the latch circuit 230 is enabled, there is a system clock tick period difference between the input and the output. Therefore, the signals 232, 234 and 236 shown in FIG. 4 have a time delay.

Similarly, refer to the datum rank 916. The signal code 316 of the first pixel clock ticks 212 in accordance with the conversion period labeled 0 is 01. The control circuit 210 generates a high-to-low waveform in signal 1212 according to the periodic signal. (Please note that in each conversion period the lower bit will be read first, so the signals 1212 will be formed as illustrated in FIG. 4.) At last, according to the signal code 318 of the color signals 218 of the datum rank 918 in the conversion period labeled 0, the control circuit 210 outputs the color signals 218 to the selector 240 in order to make the selector 240 choose the monochrome signal transmitted from the latch circuit 230. The signal code 318 is 11 in the conversion period labeled 0, so the selector 240 chooses the blue monochrome signal to output to the monitor 280. In order to match a system clock tick period difference between the input and the output when the latch circuit 230 is enabled, the signal 212 and the signal 218, which controls the selector 240, will have a system clock tick delay comparing to the datum rank 918. The system clock tick delay equals to half the period of the signal 710.

In a title 1 conversion period, the control circuit 210 is capable of reading data of the next storage check 311 in the data group 310. According to the datum rank 912, 916 and 918, the signal code 312, 316 and 318 of the latch signal 216, the first pixel clock tick 212, and the color signal 218 are separately numbered 00, 01 and 11. Since the signal code 312 is numbered 00, the control circuit 210 does not generate the latch signal 216 to enable the latch circuit 230. Therefore, the monochrome signal latched by the latch circuit 230 remains R(0), G(0) and B(0), as FIG. 4 shows for the signals 232, 234 and 236. Since the signal code 316 is numbered 01, the control circuit 210 will also generates the high-to-low waveform in the signal 1212. The signal code 318 of the color signal 218 chooses B(0) for an output of the selector 240.

In a title 2 conversion period, the signal code 318 of the color signal 218 is changed to a red code 00 so the output of the selector 240 is changed to R(0).

Responding to the system clock tick 211, the control circuit 210 reads the signal codes 312, 314, 316 and 318 of the different storage checks 311 separately in follow-up conversion periods. In a title 6 conversion period, the signal code 312 is numbered 10 so the control circuit 210 enables the high-level latch signal 216 to the latch circuit 230. The latch circuit 230 latches the second image signal 225, and transmits the R(6), G(6) and B(6) of the monochrome signals 232, 234 and 236 in the second image signal 225 to the selector 240.

In a title 7 conversion period, the signal code 316 of the first pixel clock tick 212 is numbered 11, so the signal 1212 maintains a high-level, not the high-to-low waveform as shown in title 0 to title 6 conversion period. In a title 8 conversion period, the signal code 316 of the first pixel clock tick 212 is numbered 00, so the signal 1212 maintains a low-level. By combining the corresponding signals of the signal 1212 in the numbered conversion period 7 and 8, a complete new period formed in the signal 1212 can be obtained. The same situation happens in a title 16 and 17 conversion period, and a title 25 and 26 conversion period.

There are other titles numbered starting from 0' under the signal 1212 shown in FIG. 4. These titles number all complete square waves in the signals 1212 (that means each period of the first pixel clock tick 212). Signal 1212 has 24 square waves numbered from 0' to 23' in accordance with 27 square waves of the signal 710 that numbered from 0 to 26. As mentioned before, the purpose of the present embodiment is to reduce the image pixels and the pixel clock tick periods between two horizontal synchronizing signals 266 of the screen signals 260 so as to make the image properly displayed on the monitor 280. In the signal pulse diagram shown in FIG. 4, the 27 square waves numbered from 0 to 26 of the signal 710 are reduced to 24 square waves numbered from 0' to 23' of the signal 1212. Therefore, the 720 pixel clock ticks between two horizontal synchronizing signals 266 can be reduced to 640 pixel clock ticks if the process of FIG. 4 is repeated. Moreover, the first image signals 262 of the screen signals 260 will be converted to the displaying signals 242 which the monitor 280 can accept by the conversion matrix 220. The image pixels between two horizontal synchronizing signals 266 can be also reduced to 320.

The control circuit 210 separately generates the first pixel clock ticks 212 and a displaying signal 242 to the monitor 280 according to the signal 1212 and the color signal 218. By way of the present invention image conversion apparatus 202, the screen signal 260 is converted to the first pixel clock tick 212, the second pixel clock tick 214, the displaying signal 242 outputted from the selector 240, and the horizontal synchronizing signals and the vertical synchronizing signals outputted from the wave formatter 250 in order to display the screen signals 260 properly on the monitor 280. Please note that even though the second pixel clock tick 214 is not used in this embodiment, it can be used in other embodiments according to the present invention.

In the process of reducing the numbers of the pixel clock ticks and the image pixels mentioned above, the image conversion apparatus 202 can finish the image conversion operation of each scanning line according to repeated use the data of the 27 storage checks 311 in each datum rank 310. Data formats are different between the odd scanning lines and the even scanning lines for some monitors 280. Therefore, the data groups 310 representing the odd scanning lines and the data groups 310 representing the even scanning lines can be used simultaneously in the present invention format memory 300, so as to make the image conversion operation processes successful. If the data formats of the odd scanning lines of the monitor 280 are the same with the even scanning lines, then the data group 310 of the even scanning lines will not be used. However, if the data formats of the odd scanning lines of the monitor 280 are not the same with the even scanning lines, then the data group 310 of the even scanning lines will be used.

In contrast to the prior art digital image system 100, the image conversion apparatus 202 of the present invention digital image system 200 uses stored data in the storage checks 311 of the data group 310 to control image conversion. For different monitors, a manufacturer needs only to change data within the storage checks 311 of the data group 310, so as to be capable of performing image conversion. Considerable time and cost can thus be saved.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An image conversion apparatus for converting a screen signal to display a converted screen signal on a monitor, wherein the screen signal comprises a plurality of first image signals, and the image conversion apparatus comprises:

a format memory in which at least one data group is stored, the data group having a period signal;

a signal conversion matrix for conversion of the first image signals to a plurality of corresponding second image signals;

a latch circuit electrically connected to the signal conversion matrix for latching the second image signals transmitted from the signal conversion matrix; and a control circuit electrically connected to the format memory and the latch circuit for controlling the latch circuit so that the latch circuit latches chosen second image signals according to a lock signal in the data group transferred from the format memory;

wherein the screen signal comprises a plurality of horizontal synchronizing signals and a plurality of pixel clock ticks, the horizontal synchronizing signals processing a data transmitted from the format memory, and the pixel clock ticks are between the horizontal synchronizing signals;

wherein the control circuit doubles the periods of some of the pixel clock ticks according to the period signal of the data group to adjust a number of the pixel clock ticks between the horizontal synchronizing signals, and the latch circuit correspondingly reduces samplings of the second image signals.

2. The image conversion apparatus of claim 1 further comprising a wave formatter for converting wave patterns of the horizontal synchronizing signals to wave patterns that match specifications of the monitor.

3. The image conversion apparatus of claim 1 wherein the first image signals are YUV signals.

4. The image conversion apparatus of claim 1 wherein the second image signals are RGB signals.

5. The image conversion apparatus of claim 4 further comprising a selector electrically connected to the control circuit and to the latch circuit, the control circuit controlling the selector to output monochrome signals of the RGB signals transmitted from the latch circuit according to color signals of the data groups.

6. The image conversion apparatus of claim 1 wherein the format memory has data groups for odd scanning lines and data groups for even scanning lines.

* * * * *